US005314779A

United States Patent [19]

Odell et al.

[11] Patent Number: 5,314,779

[45] Date of Patent: May 24, 1994

[54] IMAGING MEMBERS AND PROCESSES FOR THE PREPARATION THEREOF

[75] Inventors: Peter G. Odell, Mississauga; Trevor I. Martin, Burlington, both of Canada

[73] Assignee: Xerox Corporation, Stamford, Conn.

[21] Appl. No.: 933,844

[22] Filed: Aug. 24, 1992

[51] Int. Cl.[5] ..... G03G 5/00

[52] U.S. Cl. ..... 430/127; 430/130; 430/70; 430/96; 528/371

[58] Field of Search ..... 430/127, 59, 70, 96, 430/58, 57, 130; 528/370, 371, 196

[56] References Cited

U.S. PATENT DOCUMENTS 4,265,990 5/1991 Stolka et al. ..... 430/59
4,415,639 11/1983 Horgan ..... 430/57
4,551,404 11/1985 Hiro et al. ..... 430/59
4,555,463 11/1985 Hor et al. ..... 430/59
4,587,189 5/1986 Hor et al. ..... 430/59
4,605,731 8/1986 Evans et al. ..... 528/371
4,644,053 2/1987 Brunelle et al. ..... 528/371
4,888,441 12/1989 Calbo, Jr. et al. ..... 560/198

*Primary Examiner*—Steve Rosasco
*Attorney, Agent, or Firm*—E. O. Palazzo

[57] ABSTRACT

A process for the preparation of layered photoconductive imaging members which comprises forming layers comprised of a mixture of cyclic oligomers with degrees of polymerization of from about 2 to about 20 and a catalyst, wherein one layer contains a conductive filler, the second layer contains a photogenerating pigment and the third layer contains charge transporting molecules, and heating said layers to convert the cyclic oligomer mixture in each layer to a polycarbonate resin.

22 Claims, No Drawings

IMAGING MEMBERS AND PROCESSES FOR THE PREPARATION THEREOF

BACKGROUND OF THE INVENTION

This invention is generally directed to imaging members and processes for the preparation thereof. More specifically, the present invention relates to layered photoconductive imaging members with excellent mechanical characteristics, and wherein belts and drums are formed comprised of a conductive substrate, a photogenerator layer and charge transport layer generated simultaneously or in rapid succession by the polymerization of macrocyclic carbonate oligomers to form polycarbonates which can function as binder resins for the photogenerating and charge transport layers. The present invention also relates to processes for the preparation of imaging members without solvents in embodiments, wherein the polycarbonate resin binder is formed simultaneously with the charge transport and photogenerating layer. Imaging members of the present invention can be sensitive to wavelengths of from about 400 to about 800 nanometers, that is from the visible region to the near infrared wavelength region of the light spectrum. Moreover, in embodiments thereof the imaging members of the present invention possess low dark decay characteristics as illustrated herein and enable developed images, both line and solid areas, of high resolution, that is with substantially no background deposits. The imaging members of the present invention can be selected for electrophotographic, especially xerographic imaging systems. These imaging members are usually prepared by first providing on a supporting substrate a photogenerating layer of, for example, trigonal selenium, and thereafter solution coating thereover from a solvent mixture a charge transport layer and polycarbonate resin, such as MAKROLON®. Thus, the polycarbonate resin binder is in the form of a polymer when selected for the preparation of the imaging member. With the invention of the present invention, in contrast and in embodiments there is selected a monomer and this monomer is converted into a polymer binder simultaneously with the coating of the charge transport layer. The advantages of the aforementioned include, for example, the use of solvents like toluene or tetrahydrofuran, rather than the toxic and environmentally damaging chlorinated, such as methylene chloride, organic solvents to form the coating. Since solution viscosity is proportional to molecular weight, and it is the coating solution viscosity that determines the concentration for any given coating technique, the use of higher solid loadings in the coating solution is readily achievable as the cyclic oligomer precursor to the polymer possesses a much lower by, for example, orders, such as 10, of magnitude solution viscosity than the polymer itself and higher solid loadings are desirable to reduce volatile organic concentrations emitted during the coating process. The processes of the present invention and imaging members thereof allow the binder to be optionally crosslinked to provide tougher and more solvent resistant coatings. Also provided are higher, 100,000 to 300,000, molecular weight polycarbonates versus about 40,000 for spray coating molecular weight polycarbonate films formed using spray or dip coating techniques. The use of a solvent for forming a photoreceptor film may be avoided entirely with the present invention in embodiments by coating the cyclic oligomers and transport molecule mixture as a melt or a powder before curing the cyclic oligomers to the high molecular weight polymer. Additionally, by using mixtures of different structured cyclic oligomers high molecular copolymers of exact stoichiometry can be obtained that are not readily effectively obtained by either the known interfacial or melt transesterification processes for producing polycarbonates. Photogenerating pigments are usually milled in an organic solvent to obtain small, about 0.1 to 0.2 micron, particle size and preferred morphology. The polymer binder is selected with consideration of the aforementioned milling, phthalocyanine pigments, for example, are often converted to less sensitive morphologies by chlorinated solvents and thus the use of polymers that are only soluble in these solvents, such as polycarbonate, is precluded. However, polycarbonates because of their clarity and toughness are otherwise an acceptable polymer binder. This invention allows the use of polycarbonate as a binder for photogenerating pigments, since for example the crucial milling step takes placed in the presence of a mixture of macrocylic carbonate oligomers rather than in the presence of a high molecular weight polymer. The oligomer mixture is soluble in a wide variety of organic materials, and in addition, need not be dissolved since it is friable and will be broken down into small particles and widely dispersed among the pigment particles by milling. Conversion to high molecular weight polymer takes place after the solvent has been removed. Alternatively, coating may be accomplished in the absence of solvent using powder coating methods. This invention allows one to prepare charge generation layers with a polycarbonate binder for charge generation pigments. With the invention of the present application, in embodiments there is selected a mixture of macrocyclic carbonate oligomers, and this mixture is converted into a polymer after or simultaneously with the coating of the charge generation layer. The processes of the present invention and imaging members thereof allow the charge generation binder to be optionally crosslinked to provide tougher coatings that are more resistant to wear caused by toner development systems. In embodiments, the present invention is directed to the preparation of supporting substrates for layered imaging members which processes comprise the polymerization of macrocyclic oligomers to provide polycarbonate substrates where curling is minimized without the need for an anticurling layer as presently needed in many situations for layered imaging members. Curling of the substrate can result in adversely effecting the life of the imaging member, and can cause images of poor resolution. Curling is primarily caused by the mismatch of thermal expansion coefficients between substrates, such as MYLAR®, with the polycarbonate of the charge transport layer. This can be overcome by coating another layer of polycarbonate onto the side of the polyester layer opposite the charge transport layer known as the anticurl backcoating. The present invention avoids the need for the second coating by producing a substrate of polycarbonate which will possess a similar thermal expansion characteristic to the polycarbonate of the charge transport layer. By avoiding the need for the anticurl coating, this invention eliminates an additional manufacturing step, material cost, and emissions of volatile organic compounds associated with the coating step. In addition, intrinsic internal stresses can also be created in the transport layer as a result of its inability to relax completely on drying when coated onto a polyester film. These stresses will influence the life of the photoreceptor and its failure modes and may be lessened when the supporting substrate is also a polycarbonate. These and other disadvantages can be avoided or minimized with the processes of the present invention. Also, in embodiments the present invention is directed to the fabrication of supporting substrates by the in situ polymerization of macrocyclic oligomers. The aforementioned photoresponsive imaging members can be negatively charged when the photogenerating layer is situated between the charge transport layer and the substrate, or positively charged when the charge transport layer is situated between the photogenerating layer and the supporting substrate. The layered photoconductive imaging members can be selected for a number of different known imaging and printing processes including, for example, electrophotographic imaging processes, especially xerographic imaging and printing processes wherein negatively charged or positively charged images are rendered visible with toner compositions of the appropriate charge. Generally, the imaging members are sensitive in the wavelength regions of from about 400 to about 850 nanometers, thus diode lasers can be selected as the light sources in some instances.

Layered imaging members with supporting substrates, such as aluminum, and polymeric materials, photogenerating and charge transport layers, including charge transport layers comprised of aryl diamines dispersed in polycarbonates, like MAKROLON®, are known, reference for example U.S. Pat. No. 4,265,900, the disclosure of which is totally incorporated herein by reference. More specifically, in U.S. Pat. No. 4,265,900, the disclosure of which is totally incorporated herein by reference, there is illustrated an imaging member comprised of a supporting substrate, like aluminum or MYLAR®, which have a tendency to curl, a photogenerating layer, and an aryl amine hole transport layer comprised of amine molecules dispersed in a polycarbonate. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

Similar photoresponsive imaging members with squaraine photogenerating pigments are also known, reference U.S. Pat. No. 4,415,639. In this patent, there is illustrated a photoresponsive imaging member with a substrate, a hole blocking layer, an optional adhesive interface layer, an organic photogenerating layer, a photoconductive composition capable of enhancing or reducing the intrinsic properties of the photogenerating layer, and a hole transport layer. As photoconductive compositions for the aforementioned member, there can be selected various squaraine pigments, including hydroxy squaraine compositions. Moreover, there is disclosed in U.S. Pat. No. 3,824,099 certain photosensitive hydroxy squaraine compositions.

The use of selected perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances, and wherein the supporting substrate can be a metal like aluminum, or certain polymeric materials. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is revealed in Ernst Gunther Schlosser, *Journal of Applied Photographic Engineering*, Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. In accordance with the teachings of this patent, the photoconductive layer is preferably formed by vapor depositing the dyestuff in a vacuum. Also, there is specifically disclosed in this patent dual layer photoreceptors with perylene-3,4,9,10-tetracarboxylic acid diimide derivatives, which have spectral response in the wavelength region of from 400 to 600 nanometers. Also, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with a perylene pigment photogenerating component. Both of the aforementioned patents disclose an aryl amine component as a hole transport layer.

In copending application U.S. Ser. No. 537,714, the disclosure of which is totally incorporated herein by reference, there are illustrated photoresponsive imaging members with photogenerating titanyl phthalocyanine layers prepared by vacuum deposition. It is indicated in this copending application that the imaging members comprised of the vacuum deposited titanyl phthalocyanines on supporting substrates, such as certain polymeric materials and aryl amine hole transporting compounds, exhibit superior xerographic performance as low dark decay characteristics result and higher photosensitivity is generated, particularly in comparison to several prior art imaging members prepared by solution coating or spray coating, reference for example, U.S. Pat. No. 4,429,029 mentioned hereinbefore.

In copending patent application U.S. Pat. No. 5,300,392, the disclosure of which is totally incorporated herein by reference, there is illustrated a process for the preparation of photoconductive imaging members which comprises coating a supporting substrate with a photogenerator layer comprised of photogenerating pigments, and subsequently applying to the photogenerating layer a mixture comprised of charge transport molecules and cyclic oligomers, and wherein said mixture is heated to obtain a polycarbonate resin binder from said cyclic oligomers.

in copending application U.S. Pat. No. 5,300,393 is a process for the preparation of photoconductive imaging members which comprises coating a supporting substrate with a photogenerator layer comprised of photogenerating pigments and a mixture of cyclic oligomers wherein said mixture is heated to obtain a polycarbonate resin binder, and subsequently applying to the photogenerating layer a layer of charge transport molecules.

The disclosures of all of the aforementioned publications, laid open applications, copending applications and patents are totally incorporated herein by reference.

SUMMARY OF THE INVENTION

It is an object of the present Invention to provide imaging members and processes thereof with many of the advantages illustrated herein.

it is yet another object of the present invention to provide processes for the preparation of supporting substrates that can be selected for imaging members and wherein the substrate has no or minimum curl for a number of imaging cycles.

Another object of the present invention resides in the provision of supporting substrates obtained from low viscosity melts of macrocyclic carbonate oligomers in the order of 10 to 750 poise.

Further, another object of the present invention resides in a process for the polymerization of low viscosity melts of macrocyclic carbonate oligomers.

Another object of the present invention resides in the provision of supporting substrates that require no anticurl layer when selected for layered imaging members selected for xerographic imaging and printing processes.

Also, in another object of the present invention there are provided thin film polycarbonate substrates.

Further, in another object of the present invention there are provided supporting substrates with fillers therein such as silicas, or glass fiber to enable, for example, abrasion resistance, and increase the strength thereof.

Another object of the present invention resides in the provision of supporting substrates with conductive fillers therein, such as carbon black, to enable, for example, certain conductivity properties; the inclusion of foaming agents therein for lower mass and material reduction; and wherein in embodiments seamless substrates can be obtained.

It is an object of the present invention to provide imaging members and processes thereof with many of the advantages illustrated herein.

It is another object of the present invention to provide processes for photoconductive imaging members wherein the resin binder is obtained from heating a cyclic oligomer together with photogenerating pigments.

It is another object of the present invention to provide a method for obtaining a thin layer matrix of photogenerating pigment dispersed in a polycarbonate binder without the use of a chlorinated solvent.

It is yet another object of the present invention to provide processes, including effective spray, powder and dip coating processes, for the preparation of charge transport layers.

Another object of the present invention is to provide high molecular weight polycarbonates from cyclic oligomers, and wherein the polycarbonates have a molecular weight of 100,000 Daltons or greater, more specifically from 100,000 to 500,000, and preferably from 100,000 to 300,000, and with narrow distributions of 2.0 and, for example, in the range of 1.8 to 3.0.

Further, another object of the present invention resides in a process for the coating of low viscosity melts of macrocyclic carbonate oligomers and charge transport compounds onto a supporting substrate, or onto a photogenerating layer by, for example, known web methods.

In another object of the present invention there is provided the preparation of photogenerating layers by the in situ polymerization of mixtures of photogenerating pigments, and macrocyclic oligomers.

In another object of the present invent-on there is provided the preparation of photogenerating layers with minimal use or entirely without the use of volatile organic solvents.

It is another object of the present Invention to provide processes for photoconductive imaging members wherein the resin binder is obtained from heating a cyclic oligomer together with charge transport molecules.

In embodiments, the present invention is directed to the preparation of supporting substrates which comprises the polymerization of macrocyclic oligomers. More specifically, the process comprises the preparation of imaging members comprising the simultaneous formation of an imaging member comprised of a conductive substrate, a photogenerating layer and a charge transport layer wherein the conductive substrate is comprised of a polycarbonate resin binder, and wherein the resin binder is formed from a cyclic oligomer and a conductive filler such as acetylene carbon black, the photogenerating layer is comprised of photogenerating pigments dispersed in an optional polycarbonate resin binder and wherein the resin binder is formed from a cyclic oligomer, the charge transport layer is comprised of charge transport molecules and a polycarbonate resin binder and wherein the resin binder is formed from a cyclic oligomer. In embodiments, the polycarbonate resin binder obtained from the cyclic oligomer is generated in the absence of a solvent. The imaging member can be formed by generating a thin layer, about 0.25 microns to about 5 millimeters, depending on the layer, for example 20 to −70 microns for a film substrate, 2 to 5 millimeters for a drum substrate, 0.25 to 10 microns for the photogenerating layer, and 10 to 70 microns for the charge transport layer, layers of the above mixture and heating them either individually or concurrently to convert the cyclic oligomers to high molecular weight polycarbonate.

The synthesis of BP(A) cyclic oligomers is based on Brunelle et al., Jour. Amer. Chem. Soc., 1990, 112, 2399–2402, the disclosure of which is totally incorporated herein by reference. The reaction can be conducted in a one liter Morton flask equipped with a mechanical stirrer, a condenser, septum, addition funnel and heating mantle. To this flask were added 200 milliliters of methylene chloride, 7 milliliters of deionized water, 3 milliliters of 9.75 molar NAOH solution, and 2.4 milliliters of triethyl amine. Stirring and gentle reflux were begun. Bisphenol A bischloroformate, from VanDeMark Chemical Company of Lockport, N.Y., previously recrystallized from hexane, about 70.5 grams, was dissolved into 200 milliters of methylene chloride and added to a flask by means of a peristaltic pump over the course of 40 minutes. Concurrently, about 59 milliliters of about 9.75 molar sodium hydroxide solution was added by means of the addition funnel and about 2.4 milliliters of triethyl amine added by means of a syringe pump. After 40 minutes, the reaction was terminated by the addition of 200 milliliters of 1M HCl solution. The reaction mixture was transferred to a separatory funnel where the organic and aqueous layers separated and the organic layer was washed with deionized water (3 times) and once with saturated NaCl solution, then dried over magnesium sulfate. The methylene chloride was removed on a rotovap and the resulting solid was mixed with several volumes of acetone. Filtration of the acetone extract and subsequent removal of the acetone yielded 24 grams of a mixture of different ring sizes of cyclic oligomers of 4,4'-isopropylidenebisphenol carbonate. As Brunelle teaches in Macromolecules, 1991, 24, 3035, the oligomer mixture has a typical distribution of 5 percent dimer, 18 percent trimer, 16 percent tetramer, 12 percent pentamer, 9 percent hexamer and 25 percent larger ring sizes. This mixture of different ring sizes, as opposed to a single discrete size, is important to achieve a lower melting and hence processable material. Also, this paper extensively characterized the oligomers mixture. Confirmation of the product structure was determined by GPC and NMR.

About 0.6155 gram of BP(A) cyclic oligomer, about 0.4047 gram of N,N'-diphenyl-N,N'-bis(alkylphenyl)-[1,1'-biphenyl]-4,4'-diamine, and about 0.0042 gram of tetramethylammonium tetraphenylborate were mixed and ground in an agate mortar, the resulting fine powder was placed on a TEFLON® sheet on a hot plate under a nitrogen atmosphere and the hot plate temperature raised to about 300° C. over the course of 15 minutes, held at that temperature for a further 20 minutes and then allowed to cool. The obtained polymer, poly(4,4'-isopropylidenebisphenol) carbonate had GPC molecular weights Of $M_n$ of 76,000 and a $M_w$ of 176,000 with a dispersity of 2.32. This illustrates the ability of the invention to obtain a charge transport layer comprised of a transport molecule dispersed in a high molecular weight polycarbonate without the use of a solvent. It is envisaged that solventless coating can be obtained by the known powder coating techniques using a ground mixture as illustrated here, or by the known melt coating techniques, and employing the low viscosity oligomer melt mixture.

About 0.25 gram of a mixture of cyclic oligomers of 4,4'-isopropylidenebisphenol carbonate, 0.25 gram of x metal free phthalocyanine, 14.2 grams of cyclohexanone, and about 0.0005 gram of titanium butoxide were placed in a 30 milliliter bottle containing 70 grams of ⅛ inch stainless steel shot and milled at 300 rpm for 5 days. The dispersion was then coated on aluminum film, heated to about 300° C. for 30 minutes to polymerize the cyclic oligomers and then cooled. Subsequently, an approximately 20 micron thick charge transport layer of 35 weight percent of diphenyl-N,N'-bis(alkylphenyl)-[1,1'-biphenyl]-4,4'-diamine in MAKROLON® polycarbonate was overcoated on the above photogenerating layer (the CGL). Xerographic evaluation of the device was accomplished and a sensitivity of about 40 ergs/cm$^2$ was found.

About 0.85 gram of the cyclic oligomers obtained above and 0.15 gram of acetylene carbon black were ground and mixed for about three minutes with an agate mortar and pestle, About 0.0050 gram of tetrabutylammonia tetraphenylborate was added to the mixture in the mortar and a further three minutes of grinding and mixing as accomplished above. The resulting fine powder mixture was spread thinly between two TEFLON® discs upon which 2 killigram weight was placed and then heated in an inert atmosphere for about 60 to 80 minutes.

The sample, about 0.1 gram, was placed on a hot plate and heated at 300° C. A tough continuous film resulted with a resistance of about 1,000 ohms. A portion of the film was dissolved in THF, filtered, and its molecular weight measured by GPC. The GPC results that about 80 percent of the cyclic oligomers had been converted to high polymer and the molecular weight of this polymer was found to be $M_w$ of 105,000 and $M_n$ of 57,600 relative to polystyrene standards.

It is envisaged that solventless coating can be obtained by the known powder coating techniques using a ground mixture as illustrated herein, or by the known melt coating techniques and employing the low viscosity oligomer melt mixture. Moreover, it is expected that the techniques employed here to provide individual layers of an imaging member can be combined to form the entire imaging member.

The photoresponsive imaging members of the present invention can be prepared by a number of known methods, the process parameters and the order of coating of the layers being dependent on the member desired. The imaging members suitable for positive charging can be prepared by reversing the order of deposition of photogenerator and hole transport layers. The photogenerating and charge transport layers of the imaging members can be coated as solutions or dispersions onto selective substrates by the use of a spray coater, dip coater, extrusion coater, roller coater, wire-bar coater, slot coater, doctor blade coater, gravure coater, powder coating and the like, and dried at from 40° to about 200° C. for from 10 minutes to about 10 hours under stationary conditions or in an air flow. The coating is accomplished to provide a final coating thickness of from 0.01 to about 30 microns.

Imaging members of the present Invention are useful in various electrostatographic imaging and printing systems, particularly those conventionally known as xerographic processes. Specifically, the imaging members of the present invention are useful in xerographic imaging processes wherein photogenerating pigments may absorb light of a wavelength of from about 400 nanometers to about 900 nanometers. In these known processes, electrostatic latent images are initially formed on the imaging member followed by development, and thereafter transferring the image to a suitable substrate.

Examples of photogenerating pigments include metal free phthalocyanines, such as x-form phthalocyanines, metal phthalocyanines, such as phthalocyanine, vanadyl phthalocyanines, titanyl phthalocyanines, especially Type IV titanyl phthalocyanine, squaraines, bisazos, trigonal selenium, amorphous selenium, selenium alloys, such as selenium tellurium, selenium tellurium arsenic, and other known photogenerating pigments. These pigments are present in various effective amounts such as, for example, from about 5 to about 85 weight percent in polycarbonate resin binder. The thickness of this layer can vary, for example, from about 0.1 to about 10 microns in embodiments.

Moreover, the imaging members of the present invention can be selected for electronic printing processes with gallium arsenide light emitting diode (LED) arrays which typically function at wavelengths of from 660 to about 830 nanometers.

DESCRIPTION OF SPECIFIC EMBODIMENTS

A negatively charged photoresponsive imaging member of the present invention is comprised of a supporting substrate obtained with the processes of the present invention, a solution coated adhesive layer comprised, for example, of a polyester 49,000 available from Goodyear Chemical, a photogenerator layer thereover comprised of a photogenerating pigment optionally dispersed in an inactive polycarbonate resinous binder, and a hole transport layer comprised of N,N'-diphenyl-N,N'-bis(3-methyl phenyl)-1,1'-biphenyl-4,4'-diamine dispersed in a polycarbonate resinous binder.

Rather than the known substrate layers, such as a layer of insulating material including inorganic or organic polymeric materials, such as MYLAR® a commercially available polymer, MYLAR® containing titanium, a layer of an organic or inorganic material having a semiconductive surface layer, such as indium tin oxide or aluminum arranged thereon, or a conductive material inclusive of aluminum, chromium, nickel, brass or the like, there is selected the supporting substrate obtained with the processes of the present invention. The substrate may be flexible, seamless, or rigid and many have a number of many different configurations, such as for example a plate, a cylindrical drum, a scroll, an endless flexible belt and the like.

The thickness of the substrate layer depends on many factors, including economical considerations, thus this layer may be of substantial thickness, for example over 3,000 microns, or of minimum thickness providing there are no adverse effects on the system. In one embodiment, the thickness of this layer is from about 75 microns to about 300 microns.

With further regard to the imaging members, the photogenerator layer is preferably comprised of metal free phthalocyanine, or titanyl phthalocyanine pigments dispersed in resinous binders. Generally, the thickness of the photogenerator layer depends on a number of factors, including the thicknesses of the other layers and the amount of photogenerator material contained in this layer. Accordingly, this layer can be of a thickness of from about 0.05 micron to about 10 microns when the photogenerator composition is present in an amount of from about 5 percent to about 100 percent by volume. In one embodiment, this layer is of a thickness of from about 0.25 micron to about 1 micron when the photogenerator composition is present in this layer in an amount of 30 to 75 percent by volume. The maximum thickness of this layer in an embodiment is dependent primarily upon factors, such as photosensitivity, electrical properties and mechanical considerations. The charge generator layer can be obtained by dispersion coating this layer obtained with the processes of the present invention, and the cyclic binder resin with a suitable solvent. The dispersion can be prepared by mixing and/or milling the photogenerating pigment in paint shakers, ball mills, sand mills and attritors. Common grinding media such as glass beads, steel balls or ceramic beads may be used in this equipment.

Aryl amines selected for the hole transporting layer, which generally is of a thickness of from about 5 microns to about 75 microns, and preferably of a thickness of from about 10 microns to about 40 microns, include molecules of the following formula

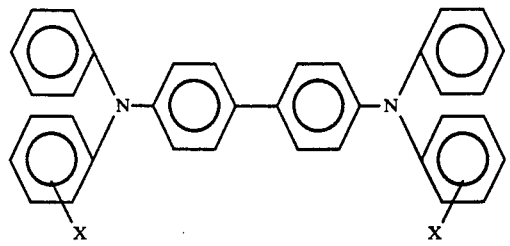

dispersed in a highly insulating and transparent organic resinous binder wherein X is an alkyl group or a halogen, especially those substituents selected from the group consisting of (ortho) $CH_3$, (para) $CH_3$, (ortho) Cl, (meta) Cl, and (para) Cl.

Examples of specific aryl amines are N,N'-diphenyl-N,N'-bis(alkylphenyl)-1,1-biphenyl-4,4'-diamine wherein alkyl is selected from the group consisting of methyl, such as 2-methyl, 3-methyl and 4-methyl, ethyl, propyl, butyl, hexyl, and the like. With chloro substitution, the amine is N,N'-diphenyl-N,N'-bis(halo phenyl)-1,1'-biphenyl-4,4'-diamine wherein halo is 2-chloro, 3-chloro or 4-chloro. Other known charge transport layer molecules can be selected, reference for example U.S. Pat. Nos. 4,921,773 and 4,464,450, the disclosures of which are totally incorporated herein by reference.

Also, included within the scope of the present invention are methods of imaging and printing with the photoresponsive devices illustrated herein. These methods generally involve the formation of an electrostatic latent image on the imaging member, followed by developing the image with a toner composition, reference U.S. Pat. Nos. 4,560,635, 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

Embodiments of the present invention include a process for the preparation of layered photoconductive imaging members which comprises forming layers comprised of a mixture of cyclic oligomers with degrees of polymerization of from about 2 to about 20 and a catalyst, wherein one layer contains a conductive filler, the second layer contains a photogenerating pigment and the third layer contains charge transporting molecules, and heating said layers to convert the cyclic oligomer mixture in each layer to a polycarbonate resin; and wherein the cyclic oligomer mixture is represented by the formula

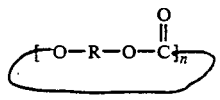

where n represents the degree of polymerization and is from 2 to about 20, R represents the principle repetition unit of the formula

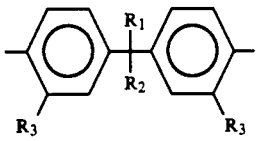

wherein $R_1$, $R_2$, and $R_3$ are independently selected from the group consisting of hydrogen, alkyl and aryl, halogen, and halogen substituted alkyl and halogen substituted aryl; and the polycarbonate obtained from the cyclic oligomers includes poly(4,4'-hexafluorolsopropylidenebisphenol) carbonate; poly(4,4'-(1,4-phenylenebisisopropylidene)bisphenol) carbonate; poly(4,4'-(1,4-phenylenebisethylidene)bisphenol) carbonate; poly(4,4'-cyclohexylidenebisphenol) carbonate; poly(4,4'-isopropylidenebisphenol) carbonate; poly(4,4'-cyclohexylidene-2,2'-dimethylbisphenol) carbonate; poly(4,4'-isopropylidene-2,2'-dimethylbisphenol) carbonate; poly(4,4'-diphenylmethylidenebisphenol) carbonate; poly(4-t-butylcyclohexylidenebisphenol) carbonate, poly(4,4'-hexafluoroisopropylidenebisphenol-co-4,4'-(1 4-phenylenebisisopropylidene)bisphenol) carbonate; poly(4,4'-hexafluoroisopropylidenebisphenol-co-4,4'-isopropylidene-2,2'-dimethylbisphenol) carbonate; poly(4,4'-hexafluoroisopropylidenebisphenol-co-4,4'-isopropylidenebisphenol) carbonate; poly(4,4'-isopropylidene-2,2'-dlmethylbisphenol-co-4,4'-isopropylidenebisphenol) carbonate; poly(4,4'-isopropylidene-2,2'-dimethylbisphenol-co-4,4'-(1-phenylethylidene)bisphenol) carbonate; or poly(4,4'-isopropylidene-2,2'-dlmethylbisphenol-co-4,4'-cyclohexylidenebisphenol) carbonate. In the above formula, alkyl can contain from 1 to about 12 carbon atoms, such as methyl, ethyl, propyl, butyl, octyl, hexyl, nonyl and the like; halogen can be chloro or bromo, for example; and aryl can be phenyl, naphthyl, benzyl, and the like. Examples of catalysts include aluminum di(isopropoxide)acetoacetic ester chelate, tetrabutylammonium tetraphenylborate, tetramethylammoniium tetraphenylborate, titanium diisopropoxide bis(2,4-pentanedione), titanium tetraisopropoxide, titanium tetrabutoxide, tetraphenylphosphonium tetraphenylborate, lithium phenoxide, and lithium salicylate.

The following Examples are provided.

EXAMPLE I

Synthesis of BP(A) Cyclic Oligomers:

The reaction was conducted in a one liter Morton flask equipped with a mechanical stirrer, condenser, septum, addition funnel and heating mantle. To this flask were added 200 milliliters of $CH_2Cl_2$, 7 milliliters of deionized water, 3 milliliters of 9.75 molar NAOH solution, and 2.4 milliliters of triethyl amine. Stirring and gentle reflux were then initiated. Bisphenol A bischloroformate, about 70.5 grams, obtained from VanDeMark Chemical Company of Lockport, N.Y., previously recrystallized from hexane, were dissolved into 200 milliliters of methylene chloride and added to the above flask by means of a peristaltic pump over the course of 40 minutes. Concurrently, about 59 milliliters of about 9.75 molar sodium hydroxide solution was added by means of the addition funnel and about 2.4 milliliters of triethyl amine added by means of a syringe pump. After 40 minutes, the reaction was terminated by the addition of 200 milliliters of 1M HCl solution. The reaction mixture was transferred to a separatory funnel where the organic and aqueous layers separated, and the organic layer was washed with deionized water (3 times) and once with saturated NaCl solution, then dried over magnesium sulfate. The methylene chloride was removed on a rotovap and the resulting solid was mixed with several volumes of acetone. Filtration of the acetone extract and subsequent removal of the acetone yielded 24 grams of a mixture of different ring sizes of cyclic oligomers of 4,4'-isopropylidenebisphenol carbonate. The ring sizes are expected to be, within a few percent, 5 percent dimer, 18 percent trimer, 16 percent tetramer, 12 percent pentamer, 9 percent hexamer and 25 percent larger ring sizes based on published analysis of such mixtures. Confirmation of the product structure was determined by GPC and NMR. GPC analysis showed a cluster of about 6 discernible peaks with the weight average molecular weight for the entire group of about 1,200 Daltons relative to polystyrene. NMR analysis was consistent with a cyclic mixture 4,4'-isopropylidenebisphenol carbonate.

EXAMPLE II

About 0.6155 gram of the BP(A) cyclic oligomer of Example I, about 0.4047 gram of N,N'-diphenyl-N,N'-bis(alkylphenyl)-[1,1'-biphenyl]-4,4'-diamine, and about 0.0042 gram of tetramethylammonium tetraphenylborate were mixed and ground in an agate mortar for about 10 minutes, and the resulting fine powder was placed on a TEFLON® sheet on a hot plate under a nitrogen atmosphere and the hot plate temperature raised to about 300° C. over the course of 15 minutes, held at that temperature for a further 20 minutes and then allowed to cool. The obtained polymer poly(4,-4'isopropylidenebisphenol) carbonate had GPC molecular weights of $M_n$ of 76,000 and a $M_w$ of 176,000. This illustrates the ability to obtain a charge transport layer comprised of transport molecules dispersed in a high molecular weight polycarbonate without the use of a solvent.

EXAMPLE II

About 0.5 gram of the BP(A) cyclic oligomer of Example I, 0.43 gram of N,N'-diphenyl-N,N'-bis(alkylphenyl)-[1,1'-biphenyl]-4,4'-diamine, 4 milliliters of $CH_2Cl_2$, and 50 microliters of a 0.01 gram/milliliter methylene chloride solution of tetrabutylammonium tetraphenylborate ($1.48\times10^{-6}$ moles catalyst/gram macrocycle) were added to a small 30 milliliter vial. The methylene chloride was removed to the atmosphere by gentle warming while under a nitrogen atmosphere on a hot plate at about 50° C. for two hours followed by about 30 minutes at about 135° C. to further remove any remaining methylene chloride. The hot plate temperature was then raised to about 300° C. for 30 minutes and then allowed to cool. A hard solid disk of a hole transporting matrix of diphenyl-N,N'-bis(alkylphenyl)[1,1'-biphenyl]-4,4'-diamine dispersed in poly(4,4'-isopropylidenebisphenol) carbonate was obtained at the bottom of the vial. The number average molecular weight, the weight average molecular weight and the $M_w/M_n$ ratio may be determined by a Waters Gel Permeation Chromatograph employing four ULTRASTYRAGEL® columns with pore sizes of 100, 500, 500, and 104 Angstroms and using THF (tetrahydrofuran) as a solvent. The molecular weight of the obtained poly(4,4'-isopropylidenebisphenol) carbonate polymer binder as determined by GPC was an $M_n$ of 105,000 and a $M_w$ of 180,000 with a dispersity of 1.8.

EXAMPLE IV

About 0.25 gram of the BP(A) cyclic oligomer of Example I, 0.25 gram of x metal free phthalocyanine, 14.2 gram of cyclohexanone, and about 0.0005 gram of titanium butoxide were placed in a 30 milliliter bottle containing 70 grams of ⅛ inch stainless steel shot and milled at 300 rpm for 5 days. The dispersions were then coated on aluminum film, heated to about 300° C. for 30 minutes to polymerize the cyclic oligomers and then cooled, resulting In a photogenerating layer of the x metal free phthalocyanine pigment dispersed in a polycarbonate. Subsequently, an approximately 20 micron thick charge transport layer of 35 weight percent of diphenyl-N,N'-bis(alkylphenyl)-[1,1'-biphenyl]-4,4'-diamine in MAKROLON ® was overcoated on the above photogenerating layer (CGL). Xerographic evaluation of the device was accomplished and a sensitivity of about 40 ergs/cm$^2$ was found.

EXAMPLE V

About 0.85 gram of the cyclic oligomers obtained in Example I and 0.1 5 gram of acetylene carbon black were ground and mixed for about three minutes with an agate mortar and pestle. About 0.0050 gram of tetrabutylammonia tetraphenylborate catalyst was added to the mixture in the mortar and a further three minutes of grinding and mixing was accomplished- The resulting fine powder mixture was spread thinly between two TEFLON ®, discs upon which a 2 killigram weight was placed and then the mixture was heated in an inert atmosphere for about 20 minutes. The heating was accomplished with a hot plate set to about 285° C. A portion, about 10 milligrams, of the product was dissolved in THF, filtered and its molecular weight measured by GPC. The GPC results indicate that about 15 percent, with 85 percent remaining as unreacted cyclic oligomers, which can be polymerized with longer times and/or higher temperatures, of the cyclic oligomers had been converted to high molecular weight polymer poly(4,4'-isopropylidenebisphenol) carbonate and the molecular weight of this polymer was found to be $M_w$ of 167,000 and $M_n$ of 88,100 relative to polystyrene standards.

The remaining sample, about 0.1 gram, was returned to the hot plate and heated at 300° C. for a further 60 minutes. A tough continuous film resulted with a resistance measured with a volt meter of about 1,000 ohms. A portion, about 10 milligrams, of the film was dissolved in THF, filtered and its molecular weight measured by GPC. The GPC results indicate that about 80 percent of the cyclic oligomers had been converted to poly(4,4'-isopropylidenebisphenol) carbonate and the molecular weight of this polymer was found to be $M_w$ of 105,000 and Mn Of 57,600 relative to polystyrene standards.

EXAMPLE VI

The process of Example 11 could be extended to larger scale whereby the mixing and grinding is accomplished mechanically and the mixture of BP(A) cyclic oligomer, N,N'-diphenyl-N,N'-bis(alkylphenyl)-[1,1'-biphenyl]-4,4'-diamine, and tetramethylammonium tetraphenylborate is subsequently coated on the interior of a spinning cylindrical mold. This layer could be heated to provide a transport layer of N,N'-diphenyl-N,N'-bis(alkylphenyl)-[1,1'-biphenyl]-4,4'-diamine dispersed in poly(4,4'-isopropylidenebisphenol) carbonate. Subsequently, the process of Example IV could be repeated on a larger scale whereby the dispersion of BP(A) cyclic oligomer of Example I, x metal free phthalocyanine, cyclohexanone, and titanium butoxide is coated on the interior of the just formed charge transport layer, heated to remove the cyclohexanone and then heated further to polymerize the cyclic oligomers to obtain a charge generation layer comprised of x metal free phthalocyanine dispersed in poly(4,4'-isopropylidenebisphenol) carbonate. Subsequently, the process of Example IV could be repeated on a larger scale whereby the mixture of BP(A) cyclic oligomer of Example I, acetylene carbon black and tetrabutylammonia tetraphenylborate catalyst are ground by mechanical means and then coated on the interior of the just formed charge generation layer and then heated to obtain a conductive substrate of acetylene carbon black dispersed in poly(4,4'-isopropylidenebisphenol) carbonate. Removal of the product from the mold should provide a functional layered imaging member.

EXAMPLE VII

The process of Example VI could be repeated except that a sing e heating step would be accomplished to effect polymerization of all three layers simultaneously- Such an imaging member, or device would be comprised of a conductive substrate of acetylene carbon black dispersed in poly(4,4'-isopropylidenebisphenol) carbonate. This substrate would be 20 to 70 microns thick when configured as a seamless belt or about 2 to 5 millimeters thick when produced as a drum. Upon the conductive substrate would be a photogenerating layer comprised of x metal free phthalocyanine dispersed in poly(4,4'-isopropylidenebisphenol) carbonate. This layer would be about 2 microns thick. Upon the photogenerating layer would be the charge transport layer of N,N'-diphenyl-N,N'-bis(alkylphenyl)-[1,1'-biphenyl]-4,4'-diamine dispersed in poly(4,4'-isopropylidenebisphenol) carbonate. This layer would be 20 to 25 microns thick.

Other modifications of the present invention may occur to those skilled in the art subsequent to a review of the present application and these modifications, including equivalents thereof, are intended to be included within the scope of the present invention.

What is claimed is:

1. An in situ process for the preparation of layered photoconductive imaging members consisting essentially of forming layers comprised of a mixture of cyclic oligomers with degrees of polymerization of from about 2 to about 20 and a catalyst, wherein one layer contains a conductive filler present in a supporting substrate layer, the second layer contains a photogenerating pigment and the third layer contains charge transporting molecules, and heating said layers to convert the cyclic oligomer mixture in each layer to a polycarbonate resin; and wherein said cyclic oligomeric mixture is represented by the formula

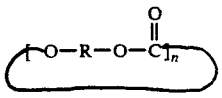

wherein n represents the degree of polymerization and is a number of form 2 to about 20, and R represents the principle repetition unit of the formula

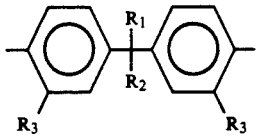

wherein $R_1$, $R_2$, and $R_3$ are independently selected from the group consisting of hydrogen, alkyl and aryl, halogen, and halogen substituted alkyl and halogen substituted aryl.

2. A process in accordance with claim 1 wherein the conductive filler is composed of acetylene carbon black, and the photogenerating pigment is comprised of a metal free phthalocyanine, a metal phthalocyanine, titanyl phthalocyanine, selenium, or benzimidazole perylenes.

3. A process according to claim 2 wherein two or ore cyclic oligomers of a different repeat unit structure are selected, and each $R_1$, $R_2$, and $R_3$ represent different substitutes to obtain a copolycarbonate.

4. A process in accordance with claim 2 wherein the obtained polymer has a weight average molecular weight of between 50,000 and 300,000.

5. A process according to claim 1 wherein the cyclic oligomer mixture contains linear oligomers as a minor component of no more than 15 percent to 20 percent by weight, and a major amount of nonlinear cyclic oligomers.

6. A process according to claim 1 wherein a crosslinking agent is added to the cyclic oligomer mixture to toughen the formed polycarbonate film.

7. A process in accordance with claim 6 wherein the crosslinking component is trisphenol A.

8. A process in accordance with claim 1 wherein the imaging member contains charge transport molecules comprised of aryl diamines.

9. A process in accordance with claim 8 wherein the charge transport molecules are comprised of aryl amines of the formula

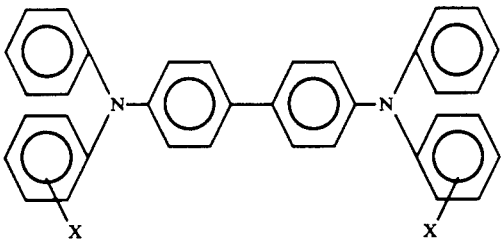

wherein X is selected from the group consisting of alkyl and halogen.

10. A process in accordance with claim 9 wherein the imaging member contains a photogenerating layer comprised of photogenerating pigments dispersed in a polycarbonate binder formed from cyclic oligomers.

11. A process in accordance with claim 1 wherein there results for the substrate, and as binder resins for the photogenerating pigment and charge transport molecules a polymer selected from the group consisting of poly(4,4'-hexafluoroisopropylidenebisphenol) carbonate; poly(4,4'-(1,4-phenylenebiisopropylidene)bisphenol)carbonate; poly(4,4'-(1,4-phenylenebisethylidene)bisphenol)carbonate; poly(4,4'-cyclohexylidenebisphenol) carbonate; poly(4,4'-isopropylidenebisphenol) carbonate; poly(4,4'-cyclohexylidene-2,2'-dimethylbisphenol) carbonate; poly(4,4'-isopropylidene-2,2'-dimethylbisphenol) carbonate; poly(4,4'-diphenylmethylidenebisphenol) carbonate; poly(4-t-butylcyclohexylidenebisphenol) carbonate; poly(4,4'-hexafluoroisopropylidenebisphenol-co-4,4'-(1,4-phenylenebisisopropylidene)bisphenol) carbonate; poly(4,4'-hexafluoroisopropylidenebisphenol-co-4,4'-isopropylidene-2,2'-dimethylbisphenol) carbonate; poly(4,4'-hexafluoroisopropylidenebisphenol-co-4,4'-isopropylidenebisphenol) carbonate; poly(4,4'-isopropylidene-2,2'-dimethylbisphenol-co-4,4'-isopropylidenebisphenol) carbonate; poly(4,4'-isopropylidene-2,2'-dimethylbisphenol-co-4,4'-(1-phenylethylidene)bisphenol) carbonate; and poly(4,4'-isopropylidene-2,2'-dimethylbisphenol-co-4,4'-cyclohexylidenebisphenol)carbonate.

12. A process in accordance with claim 1 wherein heating is accomplished at a temperature of from between about 200° C. to about 300° C.

13. A process in accordance with claim 12 wherein the catalyst is selected from the group consisting of aluminum di(isopropoxide)acetoacetic ester chelate, tetrabutylammonium tetraphenylborate, tetramethylammonium tetraphenylborate, titanium diisopropoxide bis(2,4-pentanedione), titanium tetraisopropoxide, titanium tetrabutoxide, tetraphenylphosphonium tetraphenylborate, lithium phenoxide, and lithium salicylate.

14. A process in accordance with claim 1 wherein heating is accomplished by radiative heat, inductive radio frequencies, or by microwave radiation.

15. A process in accordance with claim 1 wherein the coating of cyclic oligomer mixture and charge transport molecules is accomplished by solution coating methods.

16. A process in accordance with claim 1 wherein the coating of cyclic oligomer mixture and charge transport molecules is accomplished by melt coating methods.

17. A process in accordance with claim 1 wherein the coating of cyclic oligomer mixture and charge transport molecules is accomplished by powder coating methods.

18. A process in accordance with claim 1 wherein the heating is accomplished in the presence of a catalyst.

19. A process for the preparation of layered photoconductive imaging members, which members are comprised of a supporting substrate, a photogenerating layer, and a charge transport layer; and wherein the supporting substrate is comprised of a polycarbonate resin and the resinous binder for said photogenerating layer and said charge transport layer is a polycarbonate, the improvement residing in preparing said polycarbonate in situ by heating a mixture of cyclic oligomers with degrees of polymerization of from about 2 to about 20 and a catalyst thereby converting said cyclic oligomers to said polycarbonates and wherein said cyclic oligomer mixture is represented by the following formula

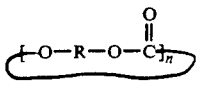

where n represents the degree of polymerization and in a number of from 2 to about 20,and R represents the principle repetition unit of the formula

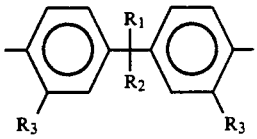

wherein $R_1$, $R_2$and $R_3$ are independently selected from the group consisting of hydrogen, alkyl and aryl, halogen, and halogen substituted alkyl and halogen substituted aryl.

20. A process in accordance with claim 19 wherein there are obtained polycarbonates with a weight average molecular weight of from about 100,000 to about 300,000, and which polycarbonates have a narrow distribution of from about 1.8 to about 3.0.

21. A process in accordance with claim 19 wherein heating is accomplished at a temperature of from about 200° C. to about 300° C., the catalyst is tetramethyl ammonium tetraphenyl borate, the photogenerating pigment is comprised of x-metal free phthalocyanine, the charge transport molecules are comprised of N,N'-diphenyl-N,N'-bis(alkylphenyl)-[1,1'-biphenyl]-4,4,'-diamine, and the polycarbonate obtained is poly(4,4'-isopropylidenebisphenol) with a weight average molecular weight, $M_w$, of from about 167,000 to 180,000.

22. A process in accordance with claim 19 wherein the catalyst is titanium butoxide.

* * * * *